United States Patent [19]

Sciambi et al.

[11] Patent Number: 4,591,022

[45] Date of Patent: May 27, 1986

[54] INSULATING ENCLOSURE FOR A CEILING OPENING

[76] Inventors: Orlando L. Sciambi, 22 Terrace Rd., Norristown, Pa. 19401; Frank J. Valtri, Box 1222, Warminster, Pa. 18974

[21] Appl. No.: 677,726

[22] Filed: Dec. 4, 1984

[51] Int. Cl.[4] ..... E06B 5/18

[52] U.S. Cl. ..... 182/47; 49/401; 52/36

[58] Field of Search ..... 182/47, 46; 220/444; 52/36, 202; 49/401

[56] References Cited

U.S. PATENT DOCUMENTS

| | | | |
|---|---|---|---|
| 2,321,499 | 6/1943 | Marschke | 182/81 |
| 3,332,167 | 7/1967 | Fayer | 49/33 |
| 3,420,363 | 1/1969 | Blickensderfer | 220/444 |
| 3,969,868 | 7/1976 | Bainter et al. | 52/622 |
| 4,151,894 | 5/1979 | Edwards | 182/77 |
| 4,281,743 | 8/1981 | Fuller | 182/46 |
| 4,299,059 | 11/1981 | Smith | 49/501 |
| 4,312,423 | 1/1982 | Helbig | 182/46 |
| 4,332,114 | 6/1982 | Goebel et al. | 52/36 |
| 4,337,602 | 7/1982 | King | 52/202 |
| 4,344,505 | 8/1982 | Waters et al. | 182/47 |

*Primary Examiner*—Reinaldo P. Machado
*Attorney, Agent, or Firm*—Robert C. Podwil

[57] ABSTRACT

An insulating enclosure for a ceiling opening of the kind typically provided for a pull-down folding stair provides an inexpensive and simple structure for enclosing and insulating the opening. The structure comprises wall portions and a top portion overlying the wall portion when the apparatus is operatively disposed, the wall portions and top portions comprising modular insulating block-like members. The block-like members may be made of foam, encased in corrugated board or plastic sheet, interconnected by tabs or tape.

16 Claims, 11 Drawing Figures

INSULATING ENCLOSURE FOR A CEILING OPENING

BACKGROUND OF THE INVENTION

This invention relates to an insulating enclosure for a ceiling opening, and more particularly, to a cap-like enclosure for a ceiling opening of the kind associated with a pull-down folding stair.

As is well known, pull-down folding stairs are often used for access, in homes or other building structures, to overhead areas such as attics or the like. Typically, such stairs fold or retract upwardly into a frame secured between the joists of the structure, and the folded stairway is covered when so retracted by a panel associat,ed with the ceiling. Folding stairs of the foregoing type are favored for use in connection with areas to which access is only occasionally required, because, unlike conventional fixed stairways, folding stairs take up no floor space.

It has been found that folding stairs and the enclosures in which they are typically mounted are difficult to insulate, and can account for relatively high heat losses. This is so because the area of the frame into which the stair folds, unlike surrounding areas between structural joists and above ceilings, is devoid of insulation. The thin cover panel usually associated with the stair provides little resistance to heat loss by radiation, conduction or convection. The problem is made more acute in situations in which the ceiling with which the stair is associated divides an inhabited, and therefore heated or cooled, space, and a space which is not temperature controlled or is in communication with ambient atmospheric conditions.

It has also been observed that the nature and construction of folding stairs makes it difficult to insulate such stairways merely by adding conventional insulation. Because it is necessary to have access through the ceiling opening in which the stair is mounted, conventional roll insulation cannot readily be used. Moreover, insulation lying above the stair and the ceiling opening would creates difficulties with access to the overhead space, and is not, in any event, particularly effective. One reason for this is that in the folded position, the stair mechanism usually extends well above the floor line. Therefore, a simple blanket of insulation, laid over the opening, is ineffective, because the stair mechanism lifts the blanket from the floor when the stair is closed.

In view of the above, it has heretofore been proposed to provide insulating caps or covers for folding stairs. In this regard, U.S. Pat. No. 4,281,743, issued Aug. 4, 1981, to George C. Fuller suggested an insulating enclosure, fabricated in several embodiments from foamed plastic polymeric material, held together by tongue and groove joints.

U.S. Pat. No. 4,312,423, issued Jan. 26, 1982, to Earl G. Helbig, suggested the use of foamed material as an internal liner for an insulating cap, the cap itself being made of corrugated paper or other suitable material. In U.S. Pat. No. 4,344,505, issued Aug. 17, 1982, to Waters et al., it was proposed that an insulating cap be made of expanded polystyrene, the top of the cap being a slab-like member, hingedly secured to a rectangular frame.

U.S. Pat. No. 4,151,894, issued May 1, 1979, to Robert A. Edwards, suggested a rigid insulating cap, provided, however, with wheels to facilitate its rolling removal from the area around the ceiling opening.

Other insulating enclosures, caps or devices are illustrated in U.S. Pat. Nos. 2,321,499, issued June 8, 1943 to Marschke; 4,299,059, issued Nov. 10, 1981 to Smith; and 4,337,602, issued July 6, 1982 to King.

Prior art arrangements have generally, once installed, been made up of one large unit, requiring substantial additional head room and/or floor space to accommodate the cap or cover in its open position. By contrast, the present invention requires no additional floor space, and, in a presently preferred embodiment, needs only twenty-six inches (26″) of headroom over the opening.

BRIEF DESCRIPTION OF THE INVENTION

It is, accordingly, a principal object of this invention to provide an insulating enclosure which is simple, inexpensive and effective, and which may be made from readily available and easily worked materials.

It is another object to provide an insulating enclosure constructed from modular elements, and which, by reason of its construction, provides easy access through the opening when access is desired.

Other objects will appear hereinafter.

The foregoing and other objects of this invention are realized, in a presently preferred form of the apparatus, by an insulating enclosure which comprises a wall portion, disposed around the periphery of the opening with which the enclosure is associated, and a removable top-forming member, which comprises plural panels, articulated in edge-to-edge fashion, providing a top for the enclosure. The wall portion, in the presently preferred from of the apparatus, includes a fixed portion, secured around part of the periphery of the opening and another portion secured to the top forming member, displaceable with the top forming member when access through the opening is desired. When the top-forming member is operatively disposed, the wall portion associated with the top-forming member and the wall portion secured arounu the periphery of the opening form a substantially continuous peripheral wall, and the wall and the top member, taken together, form a substantially continuous enclosure.

The top member and its associated wall portions are so arranged that the top member may be displaced to a stable "open" position wherein the enclosure is configured for access through the ceiling opening. Further, two wall portions secured around the periphery of the opening may be arranged for displacement from their operative, wall-forming position, to provide further ease of passage through the opening.

In presently contemplated forms of the invention, the wall portion and top-forming member are made from easily worked, readily available and relatively inexpensive materials. For example, in a presently contemplated form of the apparatus, the modules which make up the wall portion and the panels which make up the top-forming member comprise die-cut corrugated cardboard skins, assembled around insulating cores of plastic polymeric foam. The modules may be interconnected at various places by tabs extending from the modules and staples, some of the tabs providing hinges, and some of the connections being fixed or rigid. In some instances, staples alone may be used to interconnect the modules, and certain of the connections between the structural members may be effected by tabs and cooperating slits.

For the purpose of illustrating the invention, there is shown in the drawings a form of the invention which is presently preferred. It should be understood, however, that the invention is not limited to the precise arrangements and instrumentalities shown.

DETAILED DESCRIPTION

Figure 1:
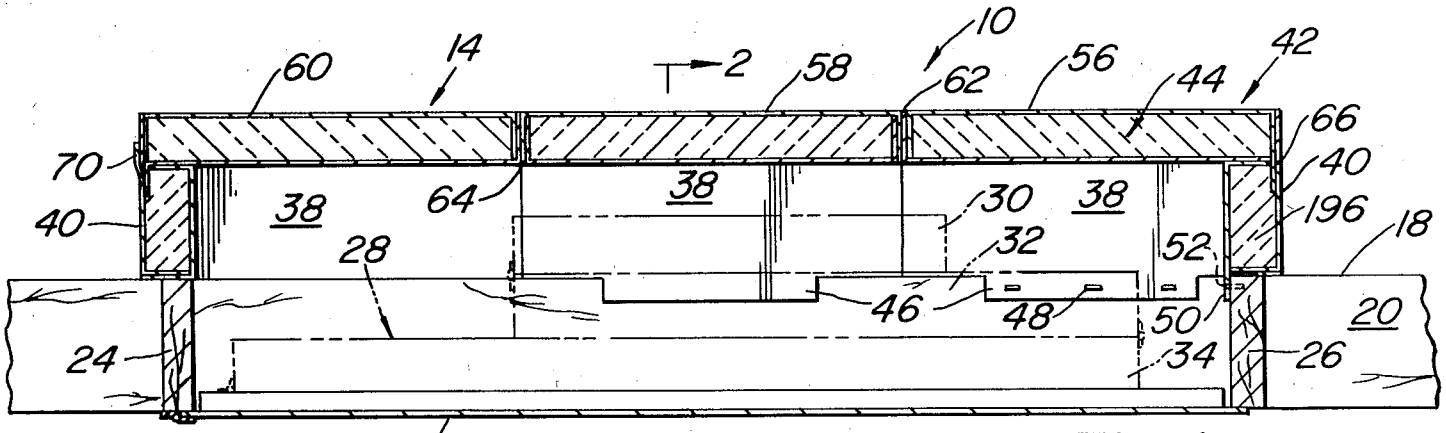
FIG. 1 is a side elevation view, in longitudinal cross-section, showing apparatus in accordance with the present invention and the manner in which it cooperates with a ceiling opening.
Figure 2:
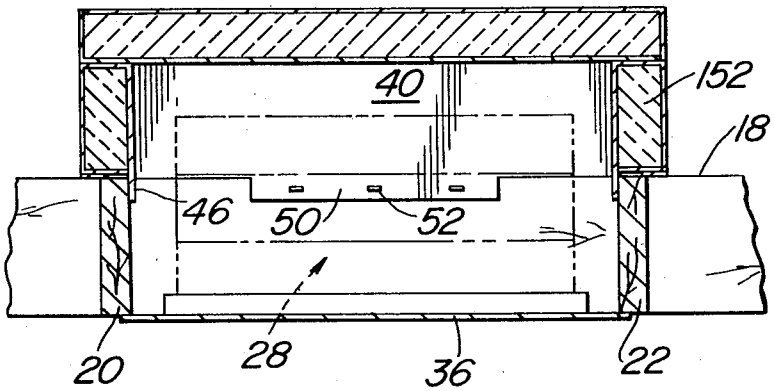
FIG. 2 is a cross-sectional view, taken along the line 2—2 in FIG. 1.
Figure 3:
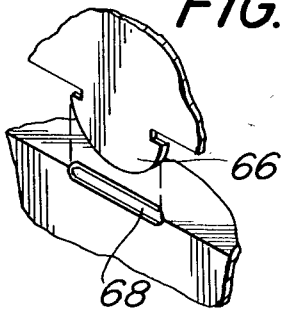
FIG. 3 is a partial view, in perspective, showing a tab and slit used in the present apparatus.
Figure 4:
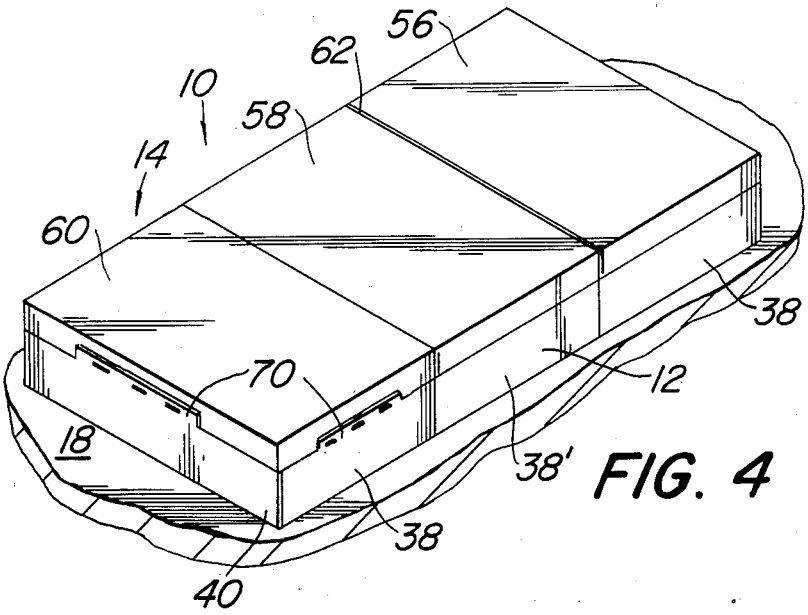
FIG. 4 is a perspective view, showing the apparatus in an operative configuration, overlying and insulating a ceiling opening.

Referring now to the drawings in detail, wherein like reference numerals indicate like elements, there is seen in FIGS. 1, 3 and 4 an insulating enclosure designated generally by the reference numeral 10. The enclosure 10 is made up of assemblage of individual modular elements, forming, in general, a peripheral wall 12 and a top 14. The wall 12 and top 14, when operatively disposed as depicted in FIGS. 1, 2 and 4, form a continuous "cap" or enclosure for an opening, designated generally by the reference numeral 16, in a horizontal partition (ceiling or floor) 18. For convenience, the horizontal partition 18 is hereafter referred to as a "ceiling" 18.

Referring to FIGS. 1 and 2, the ceiling 18 includes spaced parallel joists 20 and 22, between which cross braces 24 and 26 extend.

By way of illustration, disposed within the space defined by the joists 20 and 22 and the cross braces 24 and 26, and depicted in phantom in FIG. 1, is a conventional folded pull-down stair, designated generally by the reference numeral 28. The stair 28, it will be seen, includes articulated ladder sections 30, 32 and 34, hingedly interconnected so as to unfold, when desired, to provide a stair from the ceiling 18 to a floor (not shown) below it. A panel 36 is affixed to the ladder section 34 of the stair 28, and lies flush with the surface of the ceiling 18 when the stair 28 is retracted.

The wall 12 is made up of modular units, preferably of just two kinds. Referring to FIGS. 1 and 2, modules 38 form side walls or rails of the enclosure 10. Modules 40, somewhat different in their dimensions from the modules 38, form end walls or rails. In each instance, the modules comprise a "skin" member, designated generally by the reference numeral 42, enclosing a core, designated generally by the reference numeral 44, of insulating material. Preferably, the skin member 42 is made of corrugated board or other easily-worked material, and the core is made of closed-cell foamed polymeric material, such as the foamed polystyrene material, commercially available in block, sheet or bar form. In an alternative form of the invention, not shown, the skin member 42 may be plastic sheet or film.

Upon installation of the enclosure 10, certain of the modules 38 of the wall 12 are fixedly secured around a portion of the periphery of the opening 16. For this purpose, as is perhaps best seen in FIGS. 1 and 7, those modules 38 have extended flaps 46 which may be stapled or nailed, as at 48, to joists, such as the joist 20. Similarly, one of the modules 40 provides an end rail, which like the above-described modules 38, has a flap 50, which may be stapled or nailed, as at 52, to the cross brace 26. The side and end rails fixedly secured around the opening 16 provide a fixed wall portion, the purpose and operation of which will shortly be described.

The top 14 comprises, in the illustrated form of the apparatus, three panels 56, 58 and 60, hingedly interconnected at respective edges in accordian fashion. In this regard, referring to FIGS. 1 and 6, a hinge, formed by a flap 62 at a fold line adjacent the bottom edges of the panels 56 and 58, enables pivoting of these panels with respect to each other about a hinge line at their bottom edges. A hinge, formed by a flap 64, is disposed between the panels 58 and 60, at a fold line disposed adjacent the top surfaces of the panels 58 and 60. Thus, the panels 58 and 60 can rotate with respect to each other about a hinge line adjacent their respective upper faces. Alternatively, the hinges between the panels 56 and 58 and 60 may be formed by die-cut flaps (not illustrated) projecting from the panels, and stapled to the adjacent panel.

The panel 56 is also hingedly connected to the module 40, which provides an end rail, by means of tabs 66 (best seen in FIGS. 1, 6 and 3) which cooperate with slits 68 in the modular unit 40.

Figure 5:
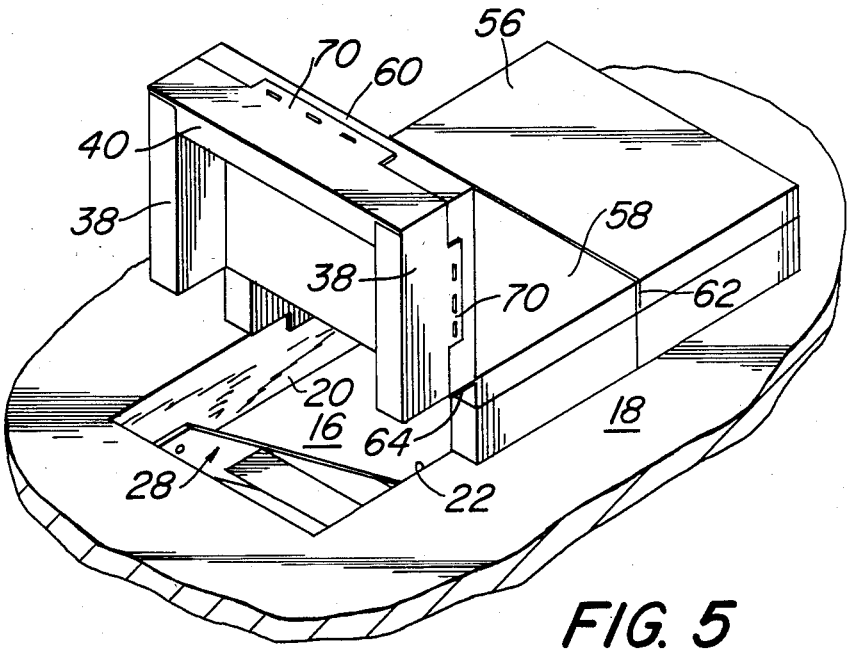
FIG. 5 is a perspective view, generally similar to FIG. 4, but showing the apparatus in an intermediate position, between the operative position shown in FIG. 4 and an open position.
Figure 6:
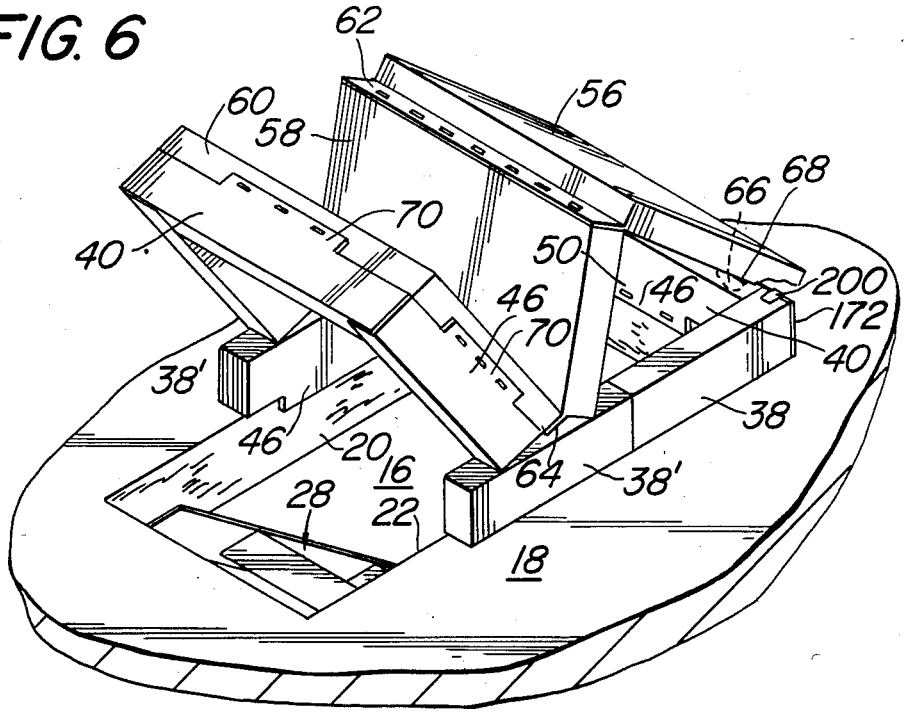
FIG. 6 is another perspective view, also showing the apparatus in an intermediate position.

Referring to FIGS. 5 and 6, associated with the panel 60, but not secured to the ceiling 18, are wall-forming modules units 38 and an end-forming module 40. Such modules 38 and 40 may be secured to the panel 60 by tabs 70 and staples, or in other expedient ways, such as staples alone.

Figure 7:
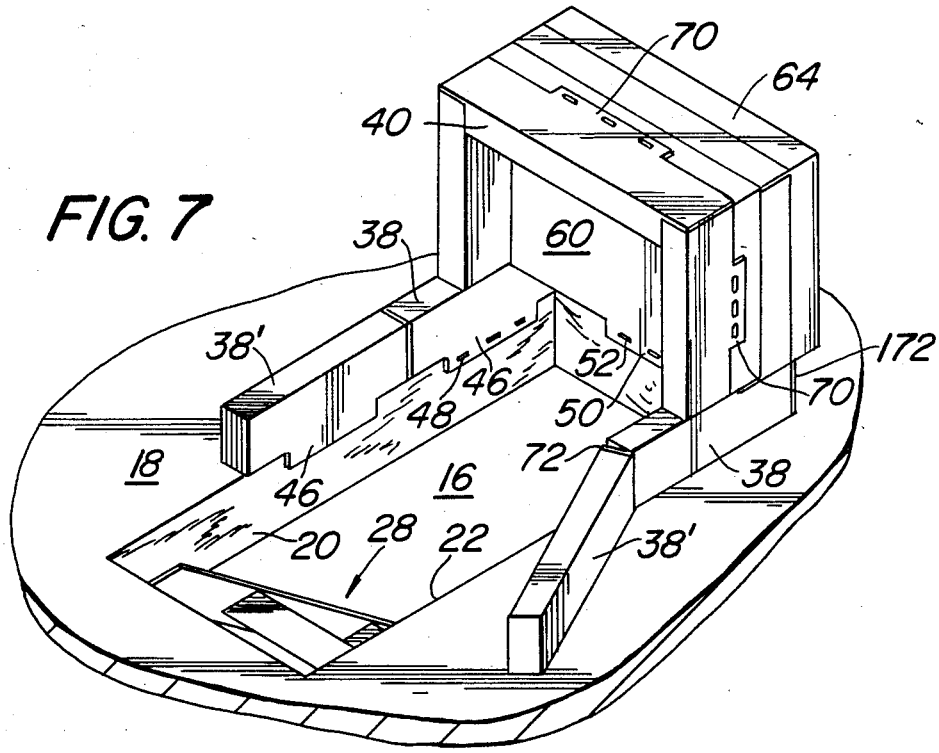
FIG. 7 is a perspective view, similar in its aspect to FIGS. 4 through 6, but showing the apparatus in a position permitting access through the ceiling opening.

FIGS. 4 through 7 illustrate the manner in which the top 14 insulating enclosure 10 may be rearranged from an operative position, as illustrated in FIG. 4, in which it overlies and insulates an opening, to an open position, illustrated in FIG. 7, in which substantially free access may be had through the opening 16.

Referring first to FIG. 5, after the stair 28 has been pulled down from its stored position between the joists 20 and 22, a user may advance partly up the stair, and, by applying pressure to the underside of the panel 60 (at the front edge), cause the panel 60 and the associated modules (side rails) and module 40 (end rail) to pivot upwardly about the hinge defined by the tabs 64 approximately to the position shown in FIG. 5. Next, by applying pressure to the underside of the panel 58 near the flap 62, the panel 56 can be made to begin to rotate about the hinge defined by the tabs 66. Referring to FIG. 7, when the panels 56, 58 and 60 reach their ultimate folded position, the panel 60 with its associated modules 38 and 40 stand upright on the side rails defined by modules 38, but the top 14, in its entirety, is maintained above the side rails by the restraint provided by the tabs 66 in association with the slits 68. In other words, ultimately, abutment of the panels 56, 58 and 60 as the top 14 reaches its fully opened position, tends to prevent the top 14 from falling off or behind the side rails. As is evident from FIG. 7, the top 14, when in its folded or retracted position, obstructs the opening 16 only to the extent of the combined depth of the 60 and the module 40. In a presently contemplated form of the apparatus, this amounts to approximately 9 inches out of a total length of the opening 16 of approximately 4½ feet.

Referring again to FIG. 7, access through the opening 16 may be further enhanced by, instead of securing the module 38' to the joist 22 in the manner of the other modules 38 and 40, securing the modules 38' to their adjacent side rail modules 38 by a hinge defined by a flap 72, positioned to form a hinge between each module 38' and its adjacent module 38. With such an arrangement, the user may, when passing thrbugh the opening 16, displace the module 38' from its alignment with its adjacent module 38, to reduce blockage caused by the side rail to a minimum.

Figure 8:
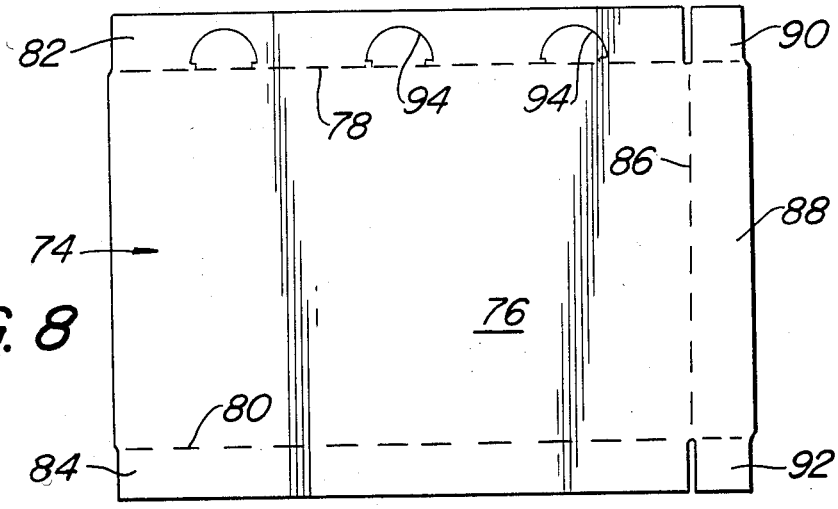
FIG. 8 is a plan view of a blank which may be used to form the skin of a panel of the top-forming member of the apparatus.
Figure 8A:
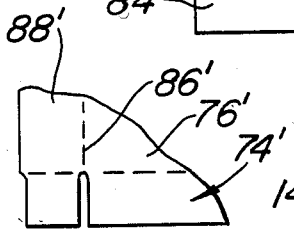
FIG. 8*a* is a partial view, similar to FIG. 8, of another form of blank used to make panels for the top-forming member.
Figure 9:
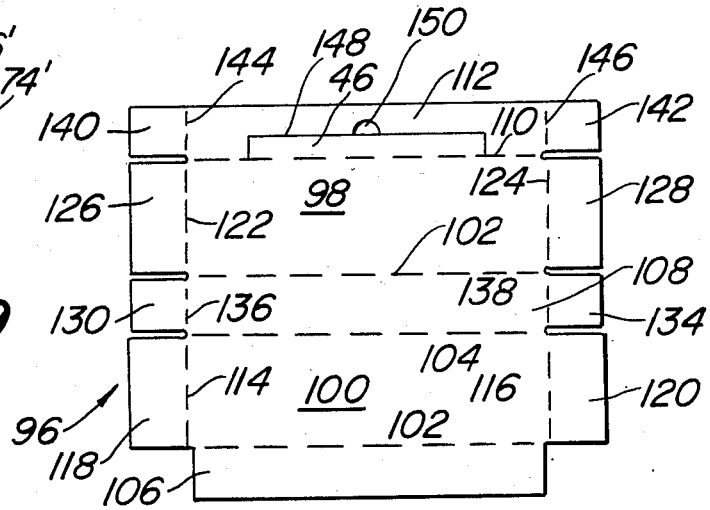
FIG. 9 is a plan view of a blank which may be used to make modules to be used to make members for the sides of the wall portions of the apparatus.
Figure 10:
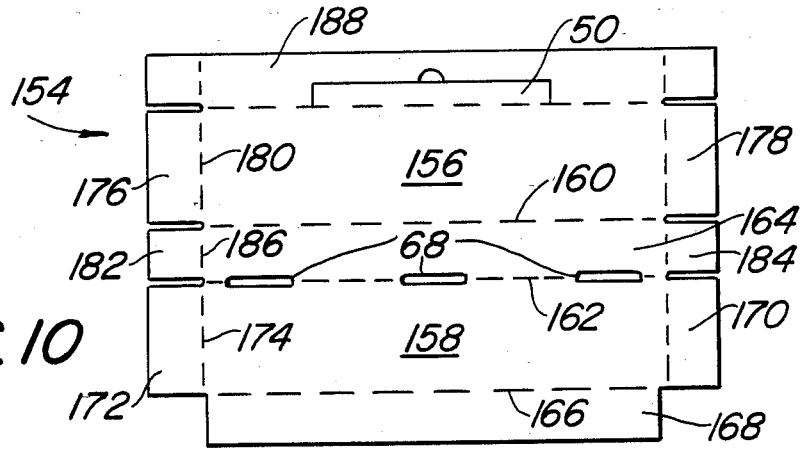
FIG. 10 is a plan view of a blank which may be used to make members to be used at the ends of the wall portion.

Referring now to FIGS. 8 through 10, there are seen blanks from which the skin members 42 of the various modules may be made. Referring first to FIGS. 8 and 8*a*, a blank, designated generally by the reference numeral 74 provides one half of the skin member of each of the panels 56, 58 and 60. The blank 74 includes a panel face 76, separated by fold lines 78 and 80 from side flaps 82 and 94. A fold line 86 separates the panel face 76 from an end flap 88, provided, in the illustrated form, with construction tabs 90 and 92.

Folding of the side flaps 82 and 84 and the end flap 88 out of the plane of the panel face 76, and securing of the construction tabs 90 to the side flaps 82 and 84, by stapling, gluing or other suitable techniques, creates from the blank 74 an open-ended tray-like structure. Arcuate slits 94 in the side flap 82 define the above-mentioned tabs 66, so that the tabs 66 can be made to project from the fold line 78 upon folding of the side flap 82 with respect to the panel face 76.

Referring to FIG. 8*a*, a blank 74', slightly smaller dimensionally than the blank 74, but lacking the arcuate slits 94 providing for the tabs 66, supplies the remainder of the skin member 42 for the panels 56, 58 and 60. The tray-like members defined by the blanks 74 and 74', when fitted around a core 44 and nested into each other, form a substantially continuous skin member 42 for the panels 56, 58 and 60. Glue, tape or other suitable means may be used to effect the final assembly.

Referring now to FIG. 9, there is seen a blank, designated generally by the reference numeral 96 which may be used to form the skin member 42 of a typical side rail module 38. The blank 96 provides rail faces 98 and 100, the rail face 100 being separated by fold lines 102 and 104 from respective side flaps 106 and 108. The rail face 98 is separated by a fold line 110 from a side flap 112. Fold lines 114 and 116 separate the rail face 100 from respective end flaps 118 and 120. Similarly, fold lines 122 and 124 separate the rail face 98 from end flaps 126 and 128. Tabs 130 and 134 are separated by fold lines 136 and 138 from the side flap 108, and in a like manner, tabs 140 and 142 are separated by fold lines 144 and 146 from the side flap 112, together with a cut or punched out portion 150, adjacent to the slit 148, which permits manipulation of the blank 96 in a manner to be described. The slit 148, it will be appreciated, defines the above-described flap 46.

It should now be apparent that the blank 96 may be wrapped around a suitable core, such as the core 152 seen in cross-section in FIG. 2, and suitably secured by glue or other appropriate means, to form a side wall module 38.

Referring to FIG. 7, if it is desired that the module 38 serve as part of the fixed portion of the wall 12, the flap 46 may be made to extend from the rail face 98 as seen in this Figure, and also as in FIG. 1. In the case, however, of the module 38', which is not secured to a joist 20 or 22, the flap 46 remains folded about the fold line 110, so as to remain in the plane of the side flap 112.

Referring now to FIG. 10, there is seen a blank 154, which may be used to form the skin member 42 of an end rail forming module 40.

The blank 154 provides rail faces 156 and 158, separated, respectively, by fold lines 160 and 162 from a rail top flap 164. Separated from the rail face 158 by a fold line 166 is a rail bottom flap 168. End flaps 170 and 172 are separated by fold lines, of which fold line 174 is typical, from the rail face 158. Similarly, end flaps 176 and 178 are separated by fold lines, such as the fold line 180, from the rail face 156. Tabs 182 and 184 are separated by fold lines, such as the fold line 186, from the rail top flap 164.

Another bottom flap 188 is separated by a fold line 190 from the rail face 156, and a slit 192 in the flap 188 defines the above-mentioned flap 50, by which the finished end rail module 40 may be secured to a structural cross brace, such as the cross brace 26. A punched out portion 194 facilitates manipulation of the flap 50.

The above-mentioned slits 68, it will be seen, are formed along the fold line 162.

The blank 154 may be formed around a suitable core, such as the cores 196 and 198, seen in FIG. 1, to form finished modules 40.

An aspect of the manner in which the modules 40 may be joined to the modules 38, whether as part of the fixed wall 12 or of the top 14, is perhaps best seen in FIG. 6. Referring to that Figure, it will be noted in reference to the module 40 associated with the fixed wall 12 that the flap 172, like the flap 170 (hidden in this view) remains in the plane of the rail face 158 and creates, in effect, an extension of that face. Thus, the end flap 172 extends across an end face of the side rail module 38 adjacent to it, so as to provide a reasonably rigid joint and positive positioning of the modules 38 and 40 relative to each other. A piece of tape 200 or other convenient fastening means serves to secure the end flap 172 of the module 40 to the adjacent module 38.

Referring to FIGS. 5, 6 and 7, it will be seen that the module 40 associated with the top 14 is similarly interconnected to the modules 38 with which it is associated. Thus, referring to FIG. 7, the end flaps 170 and 172 of the module 40 extend across the end faces of the modules 38 with which the module 40 and the panel 60 are associated. In the case of the module 40 associated with the panel 60, the flap 50 is, in effect, retracted, and indeed, may advantageously be hidden above the uncut bottom flap 168.

Although the panel 60 obviously does not hinge with respect to the module 40 as does the panel 56 with respect to the module 40 affixed to the cross brace 26, the tabs 66 associated with the panel 60 may, when assembling the top 14, be inserted into the slits 68 in the module 40 for reinforcement and positioning purposes.

The present invention may be embodied in other specific forms without departing from its spirit or essential attributes. Accordingly, reference should be made to the appended claims, rather than the foregoing specification, as indicating the scope of the invention.

We claim:

1. An insulating enclosure for a ceiling opening of the kind associated with a pull-down folding stair, comprising a wall portion and a top-forming portion, said top-forming portion being selectively movable between an operative disposition and a retracted disposition in which access may be had through the opening, said wall portion comprising a first wall portion fixedly positioned adjacent to the opening, said top-forming member being hingedly interconnected with said first wall portion and adapted to overlie said first wall portion when operatively disposed, and a second wall portion affixed to said top-forming member for movement therewith, said second wall portion forming, when said top-forming member is operatively disposed, a continuation of said first wall portion, whereby said first and second wall portions form, when said top-forming member is operatively disposed, a substantially continuous raised wall around the periphery of the opening with said top-forming member overlying said raised wall to complete said enclosure.

2. Apparatus in accordance with claim 1, wherein said first wall portion comprises a plurality of modular insulated block-like elements, so disposed as to define an end wall and at least portions of side walls around the periphery of the opening, said top-forming member comprising a plurality of interconnected insulating panels, one of said panels being hingedly interconnected at one edge thereof with one of said block-like elements, and another of said panels having affixed thereto block-like elements defining said second wall portion, said second wall portion abutting with said first wall portion when said top-forming member is operatively disposed so as to position said top-forming member with respect to said first wall portion.

3. Apparatus in accordance with claim 2, wherein said top-forming member is so configured and arranged that, when said top-forming member is in its retracted disposition, said panel of said top-forming member to which said block-like elements are affixed may be stored on edge, whereby access through said opening is maximized.

4. Apparatus in accordance with claim 2, wherein said end wall comprises one block-element and each of said side walls comprise a pair of block-like elements, said panels of which said top-forming member is comprised having a width corresponding to the length of said end wall and a width corresponding to the lengths of said block-like elements of which said side walls are comprised, said second wall portion comprising respective end and side walls, and said side walls of said second wall portion having ends thereof juxtaposed to respective ends of the first wall portion when the top forming member is operatively disposed.

5. Apparatus in accordance with claim 4, wherein said top-forming member is so configured and arranged that, when said top-forming member is in its retracted disposition, said panel of said top-forming member to which said block-like element is affixed may be stood on edge, whereby access through said opening is maximized.

6. Apparatus in accordance with claim 2, and said top forming member comprising a series of hingedly interconnected panels, one of said panels being hingedly coupled at one end thereof to said end wall, said panels being foldable relatively to each other in accordian fashion so as to permit movement of said top-forming member to its retracted disposition.

7. Apparatus in accordance with claim 6, and a block-like element of said fixed wall portion being selectively displaceable away from its normal operative disposition, so as to enhance access through the opening.

8. For use in association with a ceiling opening of the kind associated with a pull-down folding stair, an insulating enclosure comprising a wall portion adapted to be affixed adjacent to the opening and having end and side rails, a top-forming portion adapted to be hingedly coupled to said end rail and having thereon respective side and end rails, whereby, when said top forming portion is operatively disposed, said end and side rails thereon form a continuation of said fixed wall portion, said top-forming portion comprising a plurality of hingedly interconnected panels, foldable in accordian fashion to facilitate movement of said top-forming portion from an operative disposition in which said enclosure encloses the opening to a retracted disposition facilitating access through the opening.

9. Apparatus in accordance with claim 8, wherein at least one of said side rails of said fixed wall portion is adapted to be selectively displaced away from its operative disposition, so as to enhance access through the opening.

10. Apparatus in accordance with claim 8, wherein said top-forming portion comprises three panels, one of said panels adopted to be hingedly coupled to an end rail of said fixed wall portion.

11. Apparatus in accordance with claim 10, wherein one of said side rails of said fixed wall portion is adapted to be selectively displaced away from its operative disposition, so as to enhance access through the opening.

12. Apparatus in accordance with claim 11, wherein said side and end rails comprise block-like elements having flaps thereon to facilitate mounting of said elements adjacent to a ceiling opening.

13. Apparatus in accordance with claim 8, wherein said end rails, said side rails and said panels comprise core portions of insulating material, surrounded by skin members.

14. Apparatus in accordance with claim 13, wherein said skin members of said side and end rails have flaps thereon to facilitate mounting of said members adjacent to a ceiling opening.

15. For use in association with a ceiling opening of the kind associated with a pull-down folding stair, an insulating enclosure comprising a wall portion adapted to be affixed adjacent to the opening and having end and side rails, a top-forming portion adapted to be hingedly coupled to said end rail and having thereon respective side and end rails, whereby when said top-forming portion is operatively disposed said end and side rails thereon form a continuation of said fixed wall portion, said top-forming portion comprising a plurality of hingedly interconnected panels foldable in accordian fashion to facilitate movement of said top-forming portion from an operative disposition in which said enclosure encloses the opening to a retracted disposition facilitating access through the opening, said top-forming portion being so configured and arranged that, when said top forming portion is in its retracted disposition, said side rails of said top-forming portion may be made to stand substantially upright on said side rails of said fixed wall portion, whereby the floor area required for said enclosure is minimized and access through said opening is maximized.

16. Apparatus in accordance with claim 15, wherein said panels and said wall portions comprise a core of insulating material and a skin member surrounding said core, said core being of foamed plastic polymeric material, and said skin member being of corrugated board enclosing said core.

* * * * *